US009631399B1

(12) United States Patent
Zhang et al.

(10) Patent No.: US 9,631,399 B1
(45) Date of Patent: Apr. 25, 2017

(54) MINIATURIZED ELECTRONIC CAM LOCK

(71) Applicant: Digilock Asia Ltd., Kowloon (HK)

(72) Inventors: An Zhang, Shaoguan (CN); Asil T. Gokcebay, Petaluma, CA (US)

(73) Assignee: Digilock Asia Ltd., Kowloon (HK)

( * ) Notice: Subject to any disclaimer, the term of this patent is extended or adjusted under 35 U.S.C. 154(b) by 0 days.

(21) Appl. No.: 14/931,773

(22) Filed: Nov. 3, 2015

(51) Int. Cl.
*E05B 47/00* (2006.01)
*E05B 47/06* (2006.01)

(52) U.S. Cl.
CPC ..... *E05B 47/0012* (2013.01); *E05B 47/00* (2013.01); *E05B 47/06* (2013.01)

(58) Field of Classification Search
CPC ..... E05B 47/0012; E05B 47/0657; E05B 2047/0058; E05B 47/0673; E05B 47/00; E05B 49/00; E05B 47/06
USPC ..... 70/277, 278.7, 279.1, 280–283; 292/144
See application file for complete search history.

(56) References Cited

U.S. PATENT DOCUMENTS 1,578,007 A * 3/1926 Bryce ..... E05B 47/00 70/263
5,886,644 A 3/1999 Keskin et al.
5,894,277 A 4/1999 Keskin et al.
5,953,942 A * 9/1999 Doucet ..... E05B 47/0688 70/149
6,145,353 A * 11/2000 Doucet ..... E05B 47/0692 70/149
6,286,347 B1 * 9/2001 Frolov ..... E05B 47/0692 192/71
6,354,121 B1 * 3/2002 Frolov ..... E05B 63/08 292/144
6,363,762 B1 * 4/2002 Kueng ..... E05B 47/063 70/278.3
6,655,180 B2 12/2003 Gokcebay et al.
6,791,450 B2 9/2004 Gokcebay et al.
6,851,291 B2 * 2/2005 Nunez ..... E05B 47/0673 70/150
7,308,810 B2 * 12/2007 Menta San Miguel ..... E05B 47/0012 70/189
7,516,633 B1 * 4/2009 Chang ..... E05B 13/101 292/251.5
7,872,577 B2 * 1/2011 Frolov ..... E05B 45/06 340/5.32
8,490,443 B2 7/2013 Gokcebay
8,495,898 B2 7/2013 Gokcebay
8,671,723 B2 3/2014 Dayanikli et al.
2004/0099026 A1 * 5/2004 Nunez ..... E05B 47/0673 70/283
2010/0102572 A1 * 4/2010 Burmesch ..... E05B 47/0012 292/64
2011/0083482 A1 * 4/2011 Goldman ..... E05B 5/003 70/280

(Continued)

*Primary Examiner* — Suzanne Barrett
(74) *Attorney, Agent, or Firm* — Thomas M. Freiburger

(57) ABSTRACT

A very small and efficiently compact electronic cam lock has a motor-driven worm drive lock/unlock actuator that moves a blocking pin to block or to allow unlocking rotation of a locking cam of the device. A spring in the actuator provides for the actuator to move to the locking position while the cam is still in the unlocked position, but to spring into the locking position when the cam is moved back to the locking position. The lock housing includes a threaded bore for a mounting machine screw, strategically placed within the limited space of the lock mechanism.

14 Claims, 4 Drawing Sheets

(56) References Cited

U.S. PATENT DOCUMENTS

| | | | | |
|---|---|---|---|---|
| 2012/0274084 | A1* | 11/2012 | Rosales | E05B 15/04 292/196 |
| 2014/0331723 | A1* | 11/2014 | Holz | E05B 65/44 70/278.1 |
| 2015/0252591 | A1* | 9/2015 | Roatis | E05B 37/00 70/277 |

* cited by examiner

MINIATURIZED ELECTRONIC CAM LOCK

BACKGROUND OF THE INVENTION

This invention concerns locks of relatively light duty, particularly for cabinets, drawers, file cabinets, access panels and similar situations, typically used on office furniture but not on entry doors or other high-security applications such as safes. More specifically the invention encompasses an electronic cam lock that in some embodiments fits a standard cam lock opening.

Metal and wood file cabinets, desk and cabinet drawers, locker doors, access panels and doors, mail boxes, dispensers and other secure situations often utilize relatively simple lock mechanisms known as cam locks. Such cam locks may or may not involve a camming action. In some cases they move other mechanisms that are engaged with the door or drawer of the cabinet or engaged with other mechanisms that are linked to the door and drawer of the cabinet or multiple doors or drawers of the cabinet. In one of the simplest forms, a cam lock on a cabinet door typically fits in a ¾ inch diameter D-shaped or double D-shaped hole and, at the back side of the cam lock cylinder unit, has a metal blade or arm called a cam that rotates when the key is turned, from a position disengaged from surrounding cabinet hardware to a position of engagement in a slot or behind a ledge of the surrounding cabinet hardware. Other locks, such as those for desk drawers, commonly referred to as cabinet locks, involve a camming type action as the key and plug are rotated. The rotation causes a cam or nipple to move a deadbolt linearly to a locking or unlocking position or in the case of a spring loaded latch or deadlatch the rotation causes the cam or nipple to move a latch or deadlatch to unlocking position and removing the key keeps the latch or deadlatch in the extended locked position.

Metal filing cabinets often utilize cam locks, or a variation known as a plunger type lock in which a spring loaded plunger/lock cylinder located in the top horizontal margin of the cabinet, when pushed in, will lock all drawers. The use of a key releases the spring plunger to return to the outward position and unlock the drawers.

Locker and cabinet locks have included electronic locking devices, some of which utilized keypads and some of which utilized IButtons or other ID or non-volatile memory devices which work on contact to release the lock. See, for example, U.S. Pat. Nos. 5,894,277, 5,886,644, 6,655,180 and 6,791,450. The disclosures of all of these patents are incorporated herein by reference.

There is a need for a relatively simple, easily used, reliable and compact electronic lock, preferably a keypad lock but optionally operable by an electronic key, or both, for situations in which typically cam, plunger and cabinet locks were employed, and capable of fitting in a standard opening or bore of a standard cam, plunger or cabinet lock cylinder in a cabinet, door, access panel, mail box, dispenser, etc. and alternatively capable of fitting in a standard shell of a standard cam, plunger or cabinet lock cylinder in a cabinet, door, access panel, mail box, dispenser, etc. This is an objective of the current invention described below.

This invention is an improvement on the locks of U.S. Pat. Nos. 8,490,443 and 8,495,898, both owned by the assignee of the invention, and an improvement over U.S. Pat. No. 8,671,723. The disclosures of all of these patents are incorporated by reference in their entirety.

SUMMARY OF THE INVENTION

The current invention is a small, extremely compact cam lock.

The lock is generally similar to those described in the '443 and '898 patents noted above. It is an electronic cam lock for use on a door, cabinet, panel or drawer in a cabinet or furniture that provides ingress and no egress. The locks are of light to medium duty not high security such as safes or entry door. Cam locks are well known in the industry as typically having a rotary member or driver (usually a plug within a cylinder) that is turned by a mechanical key, fitted to the cylinder and which typically has at its inner side a swingable cam for engaging with fixed structure of the file cabinet or the furniture to lock the cabinet. The assignee herein has described electronic cam locks that replace a mechanical key and are of a small size so as to fit in a position of a traditional cam lock, which ordinarily occupies a ¾ inch diameter hole in the panel or cabinet and often fits in a narrow margin. The above-referenced '898 and '443 patents are examples of those electronic cam locks.

The invention further miniaturizes an electronic cam lock for a cabinet or furniture, with a highly efficient construction unknown in previous electronic cam locks.

The lock of the invention has some features similar to those of U.S. Pat. No. 8,671,723 referenced above. However, the current electronic cam lock is more efficiently constructed and with fewer parts and in a housing that takes advantage of space in a key location for receiving a fastener, allowing the lock to be operable at the margin of a file cabinet or other similar office furniture wherein the lock mechanism needs to be near a far edge of the unit.

In the electronic cam lock device of the invention, an even smaller size is achieved than the electronic cam locks of the '898 patent referenced above. In one form of the lock, a threaded cylinder extends from the back side of the lock housing, in a standard cam lock size, with a blank plug as a driver that rotates when the knob or handle is permitted rotation by a user. In this version the threaded lock cylinder enables retention of the housing on the panel or drawer by a nut screwed onto the cylinder, in the manner of prior simple mechanical cam locks. A second fastening can be made at an opposite end of the housing (which is elongated in the case of a keypad as access terminal).

However, in the case where only a cylinder plug as a driver extends back from the housing (whether or not secured to the housing or simply engaged for rotation with the front knob or handle), there will be no threaded cylinder shell for use of securing the housing to the furniture. Examples of this are shown in U.S. Pat. No. 8,495,898, FIGS. 6-12. A retaining wafer holding the plug driver in place is not strong enough against pull attacks on the lock unit and an alternative attachment means is required. Because of the lock actuating mechanism, motor and driver being at one end of the lock unit, providing a nut tube or post or cylinder to receive a machine screw at or providing a threaded screw to receive a nut at the bottom of the lock at or near that end might require extending the length of the housing farther beyond the knob or handle. This is in many cases not possible because the driver or plug unit must be close to the left or right edge of the cabinet, or the bottom of a cabinet door. In office file cabinets, for example, a cam lock often acts at the upper right corner of the cabinet. Due to the locking mechanism being placed against the cylinder/plug area in the lock housing, a securement at the right end of the housing is not possible without increasing the lock body height.

With the worm gear drive and the spring actuator employed in the lock of the invention, a space is available among the elements of the actuating mechanism (including the motor, worm gear, a pivot lever and the spring) for positioning a threaded nut tube or post or nut cylinder that can receive a machine screw secured into the nut tube from the back side of the cabinet panel. The nut tube or post is provided in the housing main body or in the back cover plate of the housing, protruding among the components of the actuating mechanism without interference with the locking and unlocking action. The space is provided due to the specific mechanism employed by the invention and is an ideal position for anchoring the lock housing to the panel or cabinet, being directly adjacent to the driver, plug or other rotational cam-driving member.

Further, the lock housing and mechanism of the invention provide for an efficiency of construction and mechanical movement not found in the above-identified prior patents. Instead of an arcuate segment of gear teeth co-acting with a rack of fixed teeth to provide a basis for pivoting of an actuator lever driven by a worm gear, as in U.S. Pat. No. 8,671,723, the mechanism of the invention includes a simple pivot mounting for a worm gear-driven actuator arm. This saves space and provides for economy of parts, assembly and structure. A flexible connection, preferably the lever spring noted above but optionally a different type of spring, extends from the pivoted arm to engage with a slidable blocking pin or plate, to slide that plate to a locking or unlocking position depending on rotation of the motor/worm gear. When in locking position the slidable pin engages in a notch or recess of a rotatable member that is part of the knob or driver assembly. The spring provides for lost motion, to allow the blocking pin to wait for the notch to be rotated back to the locking position.

The electronic cam lock of the invention is of minimal size so as to fit neatly on a file cabinet or other office furniture, with an efficient and reliable lock drive mechanism. These and other objects, advantages and features of the invention will be apparent from the following description of a preferred embodiment, considered along with the accompanying drawings.

DESCRIPTION OF PREFERRED EMBODIMENTS

Figure 1:
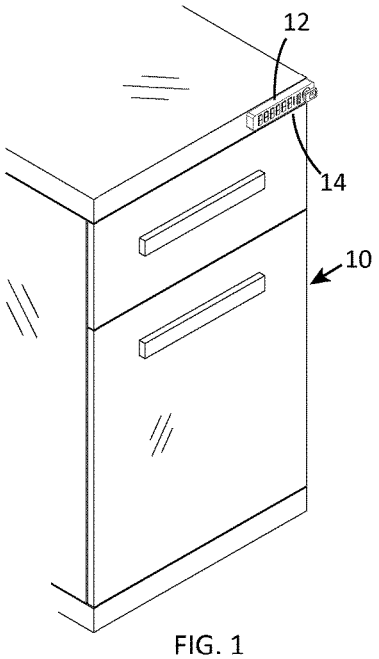
FIG. 1 is a perspective view showing an electronic cam lock of the invention installed on a file cabinet.

FIG. 1 shows a typical metal file cabinet 10 fitted with an electronic cam lock 12 of the invention. The drawing illustrates that in many situations the lock's knob or handle 14, which directly drives a spindle or driver (e.g. a blank cylinder plug), needs to be near the far edge of the cabinet (the right edge in this example). In many situations this is where mechanical lock components are located, components that block opening of one or more drawers. Because of this location requirement, it is difficult or impossible in many applications to provide a fastener, such as a machine screw, to secure the lock's housing to the cabinet at that end as there is no room at the end of the cabinet and the lock for such a fastener. If the lock's length is increased to make space for such a fastener, the lock will extend outside the parameters of the cabinet which will make the use of the fastener impossible. See FIG. 1. The exception to this problem is the case of an externally threaded cylinder, in the size and shape of a cylinder shell, that is affixed to and extending from the back of the housing, such that this threaded cylinder shell extends back through a hole in the cabinet and a nut can be provided to secure the lock at that location. However, electronic cam locks do not have such a threaded cylinder shell, when simply converting a mechanical lock to an electronic lock by replacing the keyed cylinder plug with a blank plug driver. This can be seen in some of the views of the current invention as described below. Therefore, an attachment position for the housing is needed as close as possible to the knob and the driver or actuator, on the inboard side of the knob and driver.

Figure 2:
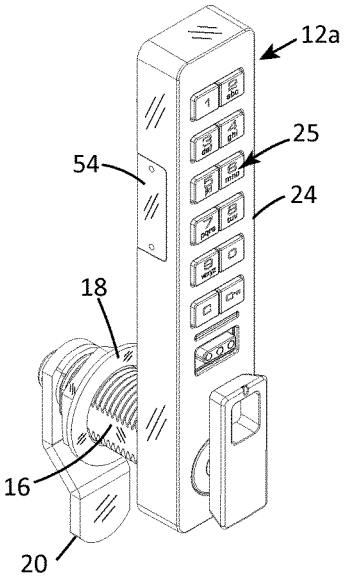
FIGS. 2 and 3 are front and rear perspective views showing a lock of the invention with a cam lock cylinder unit extending from the rear of the housing.
Figure 3:
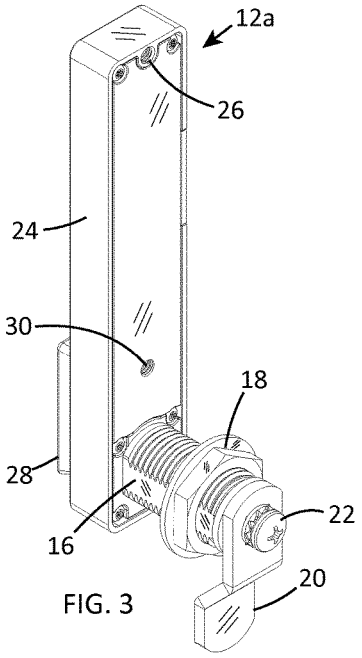

FIGS. 2 through 6 show the exteriors of locks of the invention that address this problem. Note that the locks are illustrated in vertical orientation but are often in horizontal orientation as in FIG. 1 and as in U.S. Pat. No. 8,495,898 referenced above. In FIGS. 2 and 3 the lock 12*a* actually has an externally threaded cylinder shell 16 as illustrated, with a nut 18 to provide for securing the housing to the cabinet or panel directly on the axis of rotation of the knob and driver. In these drawings the cam of the cam lock is shown at 20, secured to the end of a rotatable driver which is internal to the cylinder 16. The cam is held thereon by a machine bolt 22 as well as a non-circular hole in the cam fitted onto a boss of the same shape on the driver's end. The housing 24 of the lock preferably has a threaded hole or nut tube 26 at rear and at the end opposite the knob 28 and driver. The housing is also shown with a nut tube or barrel nut 30 near the driver axis (pursuant to the invention), which is not needed in the particular lock of FIGS. 2 and 3 but the lock of the invention preferably has a modular aspect whereby different cylinders, plugs or actuators can be secured to the rear of the lock or merely engaged with the lock's rotatable driving member for rotation.

Figure 4:
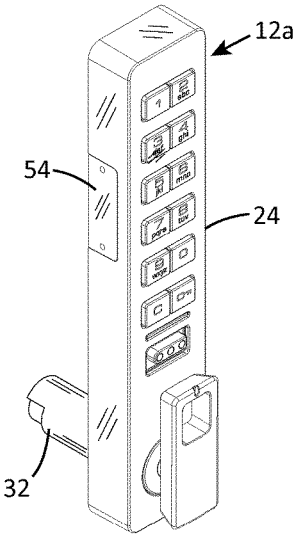
FIGS. 4 and 5 are front and rear perspective views showing a lock similar to that of FIG. 2, but with a blank plug at the back of the housing, driven by a knob or handle at front.

The locks in FIGS. 2-4 are shown with an access terminal 25 which can be a keypad as shown. This could also be an electronic key or wireless access receptacle or antenna device.

Figure 5:
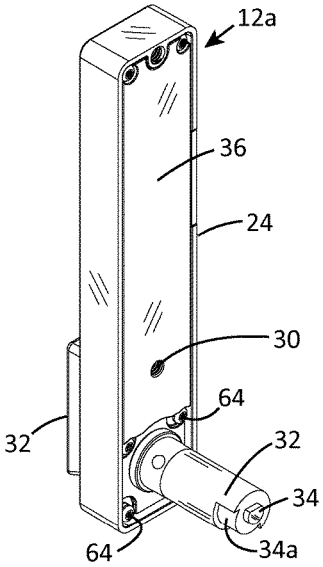

FIGS. 4 and 5 show the same lock 12*a* but with a different driver at rear, in this case a blank or dummy plug 32. No cam is shown in these views, but the drawings indicate a D-shaped cam driver boss 34 or 34*a* recess for engaging with the cam of an existing lock or other driver mechanism wherein the mechanical key cylinder plug is removed. Essentially the dummy plug has the same mechanical cam engaging properties of the removed mechanical key plug.

The plug 32, or another driver that simply comprises a shaft with a cam-engaging feature, cannot be used to firmly anchor the lock housing 24 at that end, as is required. The nut cylinder or tube 30 of the housing is positioned as close as possible to the rotation axis of the knob and driver for this purpose. The ability to place the nut tube close to the axis is an important feature of the invention and is enabled by the arrangement of components in the internal actuation system of the driver as explained below. In this embodiment the nut tube 30 is formed as part of a rear cover 36 of the lock housing.

Figure 6:
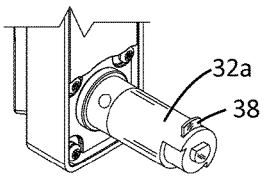
FIG. 6 is a fragmentary view showing an alternate type of blank plug.

FIG. 6 shows a variation of the dummy plug 32*a*, having an extendable wafer 38 which may be provided to lock the plug into a cylinder that is fixed into the cabinet door, panel, etc. Such a locking wafer is not of adequate strength to anchor the lock housing to the panel, and in fact the blank plug 32*a* (or 32 in FIGS. 4 and 5), as shown below, may not even be fixed to the housing but only engaged for rotation with the driving element of the lock.

Figure 7:
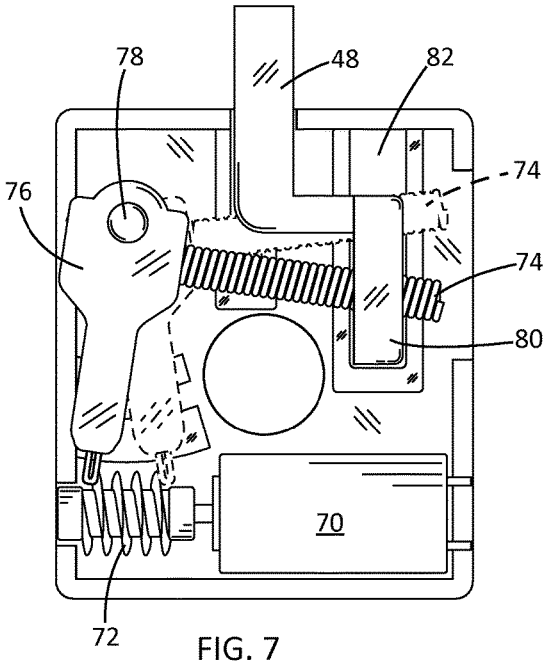
FIGS. 7 and 8 are plan views showing primary components of a lock mechanism of the invention.
Figure 8:
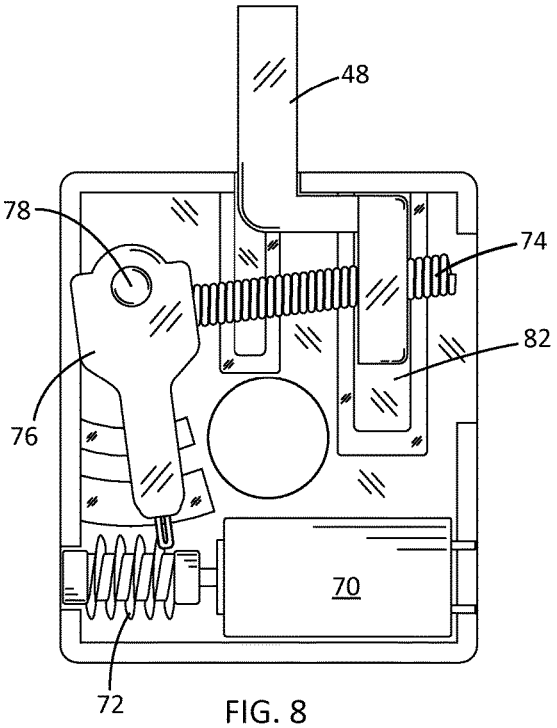
Figure 9:
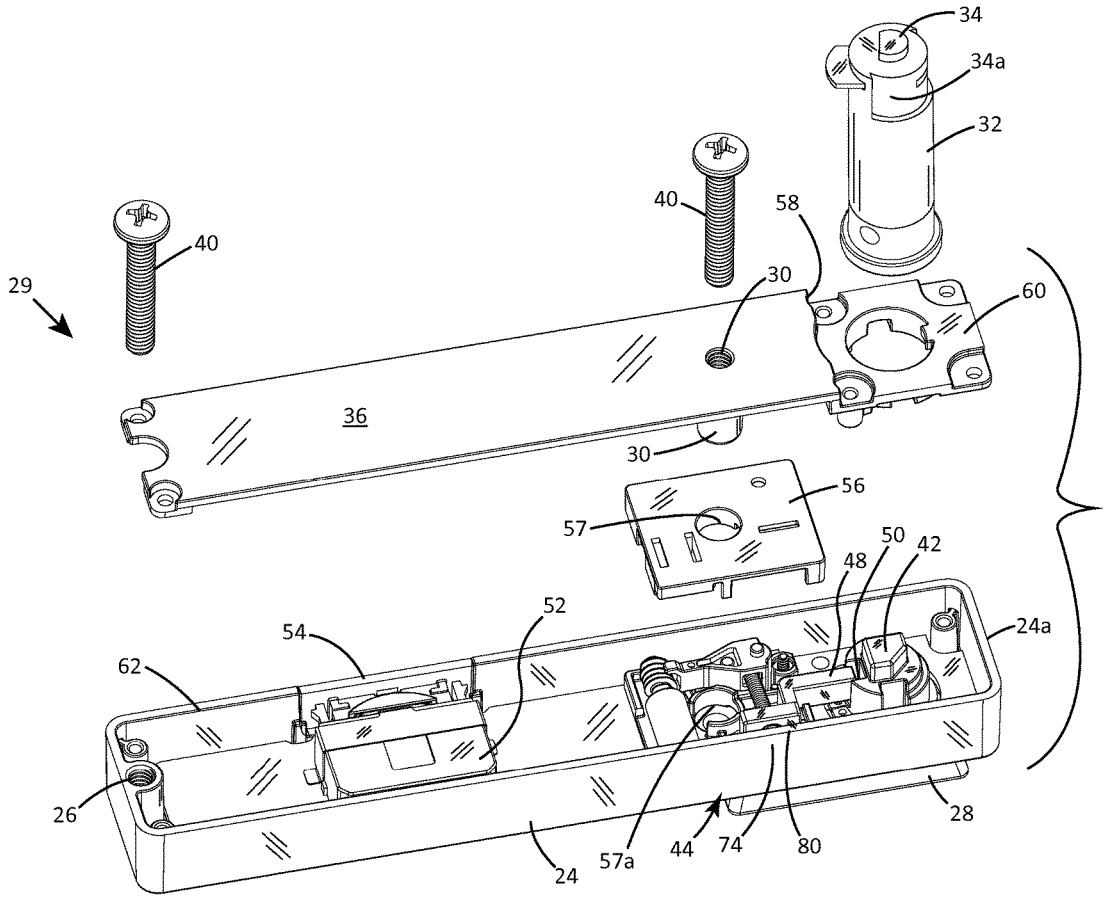
FIG. 9 is an exploded rear perspective view of an electronic cam lock of the invention, indicating the internal lock mechanism, a battery compartment and provision for receiving a machine screw in a threaded nut tube that extends into the housing.
Figure 10:
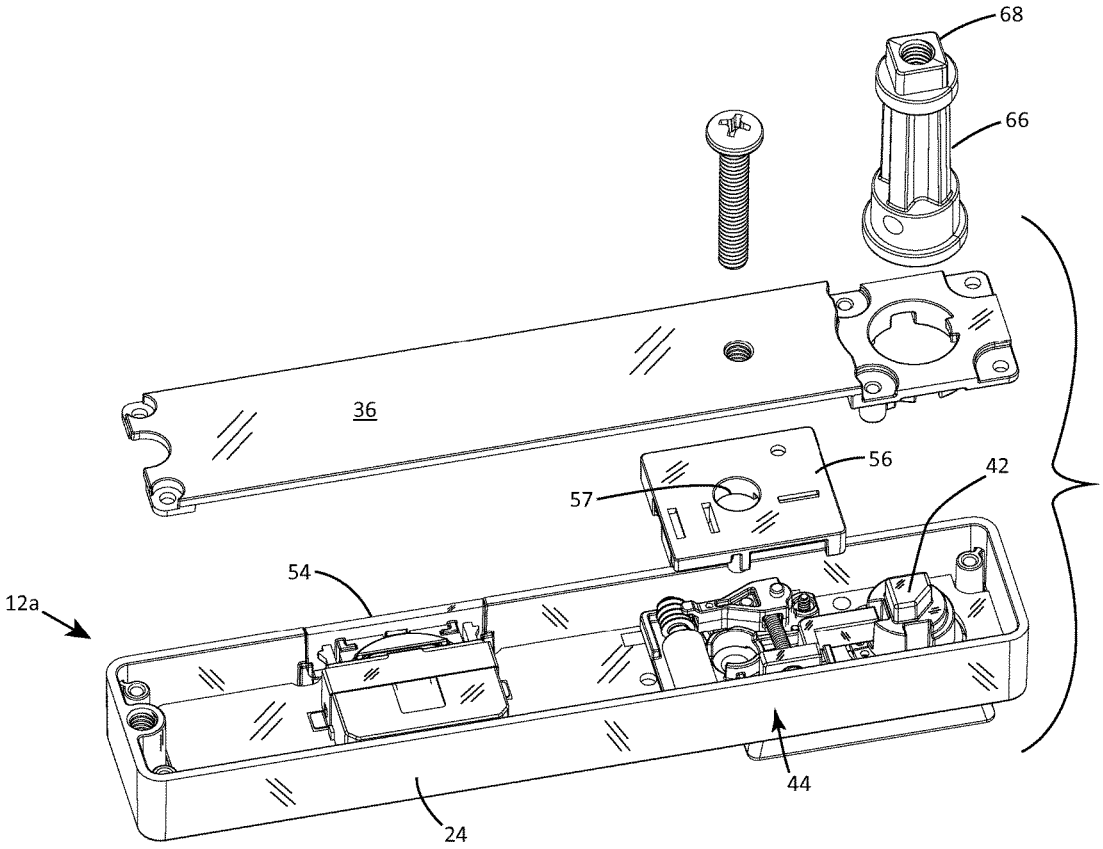
FIG. 10 is a perspective view showing an alternate type of driver or blank view at the back of the lock device.

FIGS. 7-10 illustrate the internal actuating mechanism of the lock of the invention. This mechanism allows the lock to be very compact and miniaturized, a simple mechanism with fewer parts than typical prior electronic lock devices. FIGS. 9 and 10 show the general position of components of the lock. Machine screws are shown in FIG. 9 at 40, for engaging in the nut cylinders 26 and 30, the cylinder 30 being formed on the inner side of the rear housing cover 36. The cylinder or barrel nut 30 preferably is integral with the cover, or fixed securely to its inner side. The driver, in this case a blank plug 32 as shown in FIGS. 4-6, is drivingly engaged with a shaped driving element 42 that rotates with the knob or handle 28 now being fixed with the knob to follow rotation of the knob. As is often required on file cabinets or similar situations (such as shown in FIG. 1), the knob and driving element 42 are close to an end of the housing, in this case the right end 24*a* of the housing as seen in FIG. 9. The knob may have an axis of rotation that is only about ½ inch or less from the end 24*a* of the housing (or a range of about ⅜ inch to one inch).

The mechanical actuating system 44, which is detailed in FIGS. 7 and 8, is shown located near the rotational components 28, 42 and interacting with the element 42. An extendable/retractable pin or bar 48 engages in a notch 50 to prevent rotation of the knob or handle 28 when in the locked position. It is retracted when a proper code is entered using the access device 25, to allow rotation and thus access to the cabinet.

FIGS. 9 and 10 also show a battery compartment 52 in the housing, accessible by an openable door 54 on the side of the housing (also shown in FIGS. 2 and 4). An internal cover 56 is also shown in this exploded view, positioned to cover and protect the actuator mechanism 44, and to surround, at an opening 57, a space where the nut cylinder 30 will protrude into the actuator mechanism 44 and among its components, which is an important aspect of the invention. An opening or recess of the housing is shown at 57*a* (optionally with a collar as shown) to receive the nut post or cylinder 30.

FIG. 9 also shows that the rear cover plate 36 has an offset 58 near its right end as seen in the drawing, so that the end portion 60 is receded inwardly relative to the remainder of the cover 36, which is flush with the back edge 62 of the housing body when assembled. The primary purpose of this offset is to provide room for fasteners (nuts/bolts) 64 such as seen in FIG. 5.

The location of the nut cylinder or barrel nut 30 among the mechanical components (including motor 70) of the lock is important in that it enables the fastener 40 (machine screw) to be near the end 24*a* of the housing without being located beyond the rotational elements 28, 42 and 32. Thus the knob rotation axis can be as close as needed to the end 24*a* of the housing. In a preferred embodiment the fastener 40 is located (on centers) no more than about 13/16 inch from the axis of rotation of the driver or plug 32, in the proportions generally as shown in the drawings. In fact the fastener can be even closer, with the actuating mechanism 44 closer to the driver axis, if the blocking end of the bar 48 is made shorter. The fastener can be a maximum of about ¾ inch or even ⅝ inch from the driver/plug/knob axis.

The electronic lock of the invention can be in different sizes but in one preferred form the miniaturized electronic cam lock has a length no more than about four inches, a width no more than about one inch, and a depth or thickness no more than about inch excluding the knob or handle. In a lock housing of that size, this is between the fastener 40 (on the right as seen in FIGS. 9 and 10) and the axis of rotation of the driver 32, driving element 42 and knob 28 and is no greater than about one-fifth the length of the housing. The fastener can be even closer to that driver rotation axis if, as noted above, the locking end of the pin 48 is made shorter. More broadly stated, preferred dimensions of the miniaturized lock can be in the range of about 3½ to 4½ inches in length, about ⅞ inch to 1½ inch in width, and about ⅜ inch to ⅝ inch in depth, excluding the knob or handle.

FIG. 10 is similar to FIG. 9 and shows the same lock mechanism and the same housing, but with a different form of driver or dummy plug 66. The driver 66 engages with the rotational element 42 in the same way as described above but has a different shape and a different cam-receiving end 68.

Details of the internal actuator mechanism 44 are shown in FIGS. 7 and 8. The mechanism 44 has some similarity to that shown in U.S. Pat. No. 8,671,723, in that a motor 70 driving a worm gear 72 is included, and in that a bendable coil spring 74 can be used as a cantilevered driving connection between a pivoted actuator arm 76 and the reciprocal blocking pin 48, but the mechanism is greatly simplified. The pivot arm or actuator arm 76 is pivoted from the housing at a pivot pin at 78, to swing in an arc on a fixed rotation axis as indicated in FIGS. 7 and 8. This is a simple mechanism with fewer components as compared to that of the referenced patent.

As can be seen from the drawings, the bendable coil spring 74 acts as a projecting arm or lever to move the pin 48 out from blocking inwardly or for unblocking. The spring is cantilevered from the side of the actuator arm 76. An inner part 80 of the pin 48, which can be Z-shaped as shown, is slidable within a defined slide channel 82. The spring 74 extends through an opening in the part 80 as shown in FIG. 9. When needed the spring 74 provides for "lost motion", in that the actuator mechanism may move to the blocking, locking position at a time when the lock's knob or handle has not yet been rotated back to that position. The pin 48 in this circumstance will bear against the arcuate exterior of the rotational driving element 42 (see FIG. 9) until the notch 50 appears at the right position.

Figure 8A:
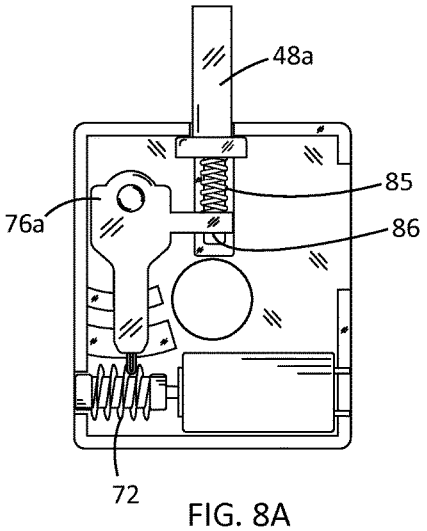
FIG. 8A is a simplified plan view showing an alternative form of the lock mechanism.

Note that the coil spring 74, which actually acts as a leaf spring, could be replaced by a leaf spring, i.e. a flat metal spring (not shown) that tends toward a predetermined configuration (such as straight) but which will bendably yield to a degree as desired. Such a leaf spring would be in the same position as shown for the coil spring 74. In addition, FIG. 8A shows another embodiment in which a different form of spring 85 is employed. Here, the pivot arm or actuator arm 76*a*, which interacts with the motor-driven worm gear 72 in the same way, has a fixed extended lever 86 to which the compression coil spring 85 is secured. The other end of the spring 85 is secured to a base end of a blocking pin 48*a*, which is then linearly slidable in a channel formed in the housing. FIG. 8A illustrates that other forms of springing elements can form the connection between the pivoted actuator arm 76 and the blocking pin 48, still reliably extending and retracting the pin while allowing for temporary lost motion for the re-locking situation just described or in the case of a user putting premature twisting pressure on the knob during unlocking so as to temporarily bind the pin 48 from retracting.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. An electronic cam lock on a door, cabinet, panel or drawer in a cabinet or furniture that provides ingress and no egress without a mechanical key, comprising:

a compact housing containing electronics and having a terminal enabling entry of a code by a user, such code when properly entered causing the electronics to permit access, the housing being positioned on a panel of said door or other structure of said cabinet or furniture to which the lock is affixed, a lock plug driver extending from a back side of the housing near one end of the housing on a driver rotation axis and engaged with a cam for locking a cabinet or furniture, and including a knob or handle on the housing for operating the lock manually without a mechanical key to rotate the lock driver when permitted by the electronics, a lock actuating mechanism within the housing, including a reciprocal blocking pin engageable with a notch in a rotatable member secured to the knob or handle and the driver, so that the blocking pin is effective to prevent rotation or allow rotation of the handle and the plug driver depending on whether the pin is extended or retracted, a driving mechanism to extend and retract the pin, including a motor with a worm drive gear, an actuator arm having a pivoted end pivotally attached to the housing for rotation about a pivot axis fixed relative to the housing and having a driven end with a worm gear follower engaged with the worm gear so that rotation of the worm gear swings the actuator arm in a first direction of rotation or a second direction of rotation, and the actuator arm being connected via a spring to the blocking pin such that rotation of the actuator arm in the first direction of rotation or the second direction of rotation is effective to move the blocking pin to an extended position or a retracted position but with flexibility for lost motion in extending or retracting the blocking pin when the blocking pin is not aligned with the notch or is binding temporarily in the notch, and a machine screw securing the housing to the door, cabinet, panel or drawer, the machine screw extending into the housing at a position close to the driver rotation axis, in a space bounded at least in part by the motor, the actuator arm and the spring, whereby said one end of the compact housing is mounted securely against the door, cabinet, panel or drawer solely by the machine screw extending into the housing at said space.

2. The electronic cam lock of claim 1, the housing including an internally threaded nut post extending into said space near the driver rotation axis and receiving said machine screw that secures the cam lock on the door, cabinet, panel or drawer.

3. The electronic cam lock of claim 2, wherein the spring is a coil spring cantilevered from the actuator arm and engaging the locking pin near an outer end of the spring so that the spring acts in flexure to provide said lost motion, said space being between the motor and the spring.

4. The electronic cam lock of claim 3, wherein the blocking pin is generally Z-shaped to provide an inner end offset from an outer end of the blocking pin, and the spring being connected to the offset inner end.

5. The electronic cam lock of claim 1, wherein the machine screw is located no more than about 13/16 inch from the driver rotation axis center to center.

6. The electronic cam lock of claim 1, wherein the machine screw is located no more than about ¾ inch from the driver rotation axis center to center.

7. The electronic cam lock of claim 1, wherein the machine screw is located no more than about ⅝ inch from the driver rotation axis center to center.

8. The electronic cam lock of claim 1, wherein the machine screw is located a center-to-center distance from the driver rotation axis that is no more than about one-fifth the length of the housing.

9. The electronic cam lock of claim 1, wherein the housing has dimensions no greater than about four inches as a length dimension, one inch as a width dimension and ½ inch as a depth dimension excluding the knob or handle.

10. The electronic cam lock of claim 1, wherein the housing has a length of about 3½ to 4½ inches, a width of about ⅞ inch to 1½ inch, and a depth of about ⅜ inch to ⅝ inch excluding the knob or handle.

11. The electronic cam lock of claim 1, wherein the lock plug driver comprises a dummy cylinder plug.

12. The electronic cam lock of claim 11, wherein the dummy plug is engaged for rotation with the knob or handle but not fixed to the knob or handle.

13. The electronic cam lock of claim 1, wherein the housing includes a battery compartment with an access door accessible on the housing as installed on the door, cabinet, panel or drawer.

14. The electronic cam lock of claim 1, wherein the terminal comprises an electronic keypad.

* * * * *